US011466349B2

(12) United States Patent
Hijii et al.

(10) Patent No.: US 11,466,349 B2
(45) Date of Patent: Oct. 11, 2022

(54) SPHEROIDAL GRAPHITE CAST IRON

(71) Applicants: Takumi Hijii, Tajimi (JP); Yoshimasa Ureshino, Miyoshi (JP); Hitoshi Sakuma, Toyota (JP); Gou Nakamura, Toyota (JP); Zhong-zhi Zhang, Kariya (JP)

(72) Inventors: Takumi Hijii, Tajimi (JP); Yoshimasa Ureshino, Miyoshi (JP); Hitoshi Sakuma, Toyota (JP); Gou Nakamura, Toyota (JP); Zhong-zhi Zhang, Kariya (JP)

(73) Assignees: TOYOTA JIDOSHA KABUSHIKI KAISHA, Toyota (JP); AISIN TAKAOKA CO., LTD., Toyota (JP)

( * ) Notice: Subject to any disclaimer, the term of this patent is extended or adjusted under 35 U.S.C. 154(b) by 0 days.

(21) Appl. No.: 16/233,535

(22) Filed: Dec. 27, 2018

(65) Prior Publication Data

US 2019/0211426 A1 Jul. 11, 2019

(30) Foreign Application Priority Data

Jan. 11, 2018 (JP) ..... JP2018-002778

(51) Int. Cl.
*C22C 37/04* (2006.01)
*C22C 33/10* (2006.01)
(Continued)

(52) U.S. Cl.
CPC ..... *C22C 37/04* (2013.01); *C22C 33/08* (2013.01); *C22C 33/10* (2013.01); *C22C 37/06* (2013.01); *C22C 37/10* (2013.01)

(58) Field of Classification Search
CPC ..... C22C 37/04
See application file for complete search history.

(56) References Cited

U.S. PATENT DOCUMENTS

2014/0352851 A1* 12/2014 Wang ..... C22C 33/08 148/543
2016/0160325 A1 6/2016 Mito et al.
(Continued)

FOREIGN PATENT DOCUMENTS

CN 102268590 A 12/2011
JP H055125 A * 8/1991 ..... C21D 5/00
(Continued)

OTHER PUBLICATIONS

Espacenet machine translation of JP-2008229640-A retrieved on Mar. 20, 2020 (Year: 2008).*
(Continued)

*Primary Examiner* — Jophy S. Koshy
*Assistant Examiner* — Joshua S Carpenter
(74) *Attorney, Agent, or Firm* — Oliff PLC

(57) ABSTRACT

A spheroidal graphite cast iron having an excellent impact strength at low temperature and a method for producing the same are provided. The present disclosure relates to the spheroidal graphite cast iron comprising: C: 3.5 mass % to 4.2 mass %; Si: 2.0 mass % to 2.8 mass %; Mn: 0.2 mass % to 0.4 mass %; Cu: 0.1 mass % to 0.7 mass %; Mg: 0.02 mass % to 0.06 mass %; Cr: 0.01 mass % to 0.15 mass %; and the balance: Fe and inevitable impurities, wherein Mn+Cr+Cu is 0.431 mass % to 1.090 mass %, a graphite nodule count is 230/mm$^2$ or less, and a pearlite fraction is 30% to 85%.

7 Claims, 5 Drawing Sheets

(51) Int. Cl.

| | |
|---|---|
| ***C22C 37/06*** | (2006.01) |
| ***C22C 37/10*** | (2006.01) |
| ***C22C 33/08*** | (2006.01) |

(56) References Cited

U.S. PATENT DOCUMENTS

| | | | | |
|---|---|---|---|---|
| 2017/0218488 | A1* | 8/2017 | Anjiki | F02F 3/0084 |
| 2018/0148808 | A1* | 5/2018 | Han | C21D 8/005 |

FOREIGN PATENT DOCUMENTS

| | | | | |
|---|---|---|---|---|
| JP | 2008229640 | A | * | 10/2008 |
| JP | 2015-010255 | A | | 1/2015 |
| KR | 1998-076417 | A | | 11/1998 |

OTHER PUBLICATIONS

Stefanescu. Classification and Basic Metallurgy of Cast Iron. ASM Handbook, vol. 1. pp. 1-13. (2014). (Year: 2014).*

Espacenet machine translation of JPH055125A retrieved on Oct. 20, 2020 (Year: 1991).*

Serrallach, Joan, et al. "Effect of Selected Alloying Elements on Mechanical Properties of Pearlitic Nodular Cast Irons." Key Engineering Materials, vol. 457, Trans Tech Publications, Ltd., Dec. 2010, pp. 361-366. (Year: 2010).*

* cited by examiner

| | Structure photograph | Pearlite fraction % | Graphite spheroidization ratio % | Graphite nodule count nodules/ $mm^2$ | Average particle size of graphite μm |
|---|---|---|---|---|---|
| Example 1 |   | 34 | 90 | 200 | 23.5 |
| Example 2 |   | 39 | 95 | 192 | 22.5 |
| Example 3 |   | 56 | 94 | 188 | 24.5 |
| Example 4 |   | 63 | 92 | 160 | 26.9 |
| Example 5 |   | 79 | 92 | 192 | 25.5 |
| Example 6 |   | 83 | 84 | 172 | 23.6 |
| Comparative Example 1 |   | 14 | 93 | 200 | 24.5 |
| Comparative Example 2 |   | 89 | 90 | 172 | 23.6 |
| Comparative Example 3 | - | - | - | 232 | 21.0 |

SPHEROIDAL GRAPHITE CAST IRON

CROSS REFERENCE TO RELATED APPLICATIONS

The present application claims priority from Japanese patent application JP 2018-002778 filed on Jan. 11, 2018, the content of which is hereby incorporated by reference into this application.

BACKGROUND

Technical Field

The present disclosure relates to a spheroidal graphite cast iron, more particularly, to a spheroidal graphite cast iron having an excellent impact strength at low temperature and a method for producing the same.

Background Art

A spheroidal graphite cast iron has been conventionally applied to engines, undercarriage parts, or driving parts of motor vehicles. The spheroidal graphite cast iron contains spheroidal graphite particles in an iron matrix, and thus an excellent strength and ductility can be expected as compared to the other cast irons.

For example, JP Patent Publication (Kokai) No. 2015-10255 A discloses that a spheroidal graphite cast iron comprising C: 3.3 to 4.0 mass % (% by mass), Si: 2.1 to 2.7 mass %, Mn: 0.20 to 0.50 mass %, S: 0.005 to 0.030 mass %, Cu: 0.20 to 0.50 mass %, Mg: 0.03 to 0.06 mass % and the balance: Fe and inevitable impurities, wherein a tensile strength is 550 MPa or more, and an elongation is 12% or more.

SUMMARY

However, when the spheroidal graphite cast iron is highly strengthened, its elongation decreases at low temperature, and the spheroidal graphite cast iron is unlikely to follow up an applied impact and consequently fractured quickly (embrittled). Therefore, a decrease in an impact strength for the applied impact due to low-temperature embrittlement becomes a problem.

In the conventional art including, for example, JP Patent Publication (Kokai) No. 2015-10255 A, although an impact value at low temperature was studied, the impact strength at low temperature was not studied.

The impact value means an impact absorbing energy which is an amount of energy consumed by a material until the material is fractured. The impact value is influenced by both a strength and an elongation of material characteristics.

The impact strength, on the other hand, means a strength for an extraordinarily applied force. The "strength" generally refers to a static strength, that is, a rupture strength (also referred to as a "tensile strength" in this specification, etc.) when an object is pulled at a very slow rate (for example, a strain rate of $10^{-2}$ to $10^{1}$ $sec^{-1}$). However, the impact strength refers to a rupture strength when an object is pulled at a fast rate (approximately 100 times or more as much as a static rate, which is 5 $sec^{-1}$, for example). The impact strength can be a design value for parts.

Accordingly, the present disclosure provides a spheroidal graphite cast iron having an excellent impact strength at low temperature and a method for producing the same.

As a result of intensive studies, the present inventors have found that, when the spheroidal graphite cast iron was produced by adjusting a cooling rate from a pouring temperature to a temperature at A1 transformation point in an iron-carbon phase diagram and a cooling rate from the temperature at A1 transformation point to a temperature at which no further transformation of iron takes place in the spheroidal graphite cast iron to a certain range, in a cooling step of a molten cast iron adjusted to have a certain composition, the produced spheroidal graphite cast iron had a graphite nodule count and a pearlite fraction that fall into a certain range, and consequently an impact strength at low temperature of the spheroidal graphite cast iron is improved. The present disclosure was completed based on the above finding.

That is, the summary of the present disclosure is as follows.

(1) A spheroidal graphite cast iron comprising:

C: 3.5 mass % to 4.2 mass %;

Si: 2.0 mass % to 2.8 mass %;

Mn: 0.2 mass % to 0.4 mass %;

Cu: 0.1 mass % to 0.7 mass %;

Mg: 0.02 mass % to 0.06 mass %;

Cr: 0.01 mass % to 0.15 mass %; and the balance: Fe and inevitable impurities, wherein Mn+Cr+Cu is 0.431 mass % to 1.090 mass %, a graphite nodule count is 230/$mm^2$ (number of nodules per $mm^2$) or less, and a pearlite fraction is 30% to 85%.

(2) A method for producing the spheroidal graphite cast iron according to (1), comprising:

(i) a preparation step of preparing a molten cast iron, and (ii) a cooling step of cooling the molten cast iron prepared in (i), wherein the cooling step of (ii) comprises:

(a) a first cooling step of adjusting a cooling rate from a pouring temperature to a temperature at A1 transformation point in an iron-carbon phase diagram to 15° C./min to 25° C./min; and (b) a second cooling step of adjusting a cooling rate from the temperature at A1 transformation point to a temperature at which no further transformation of iron takes place in the spheroidal graphite cast iron to 5° C./min to 20° C./min.

The present disclosure provides the spheroidal graphite cast iron having an excellent impact strength at low temperature and a method for producing the same.

DETAILED DESCRIPTION

Figure 1:
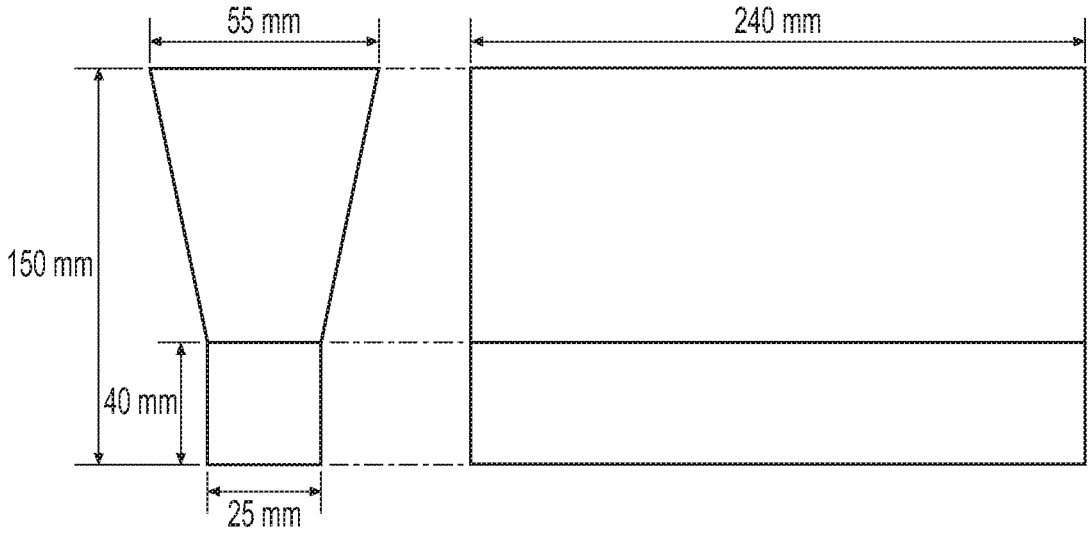
FIG. 1 shows a Y-block mold used in Examples and Comparative Examples.

Hereinafter, some embodiments of the present disclosure will be described in detail.

In this specification, features of the present disclosure will be described by appropriately referring to the drawings. The drawings are exaggerated in terms of their size and shape of each part for clarification and do not accurately show the actual size and shape. Thus, the technical scope of the present disclosure is not limited to the size and shape of each part shown in these drawings. Additionally, a spheroidal graphite cast iron and a method for producing the same of the present disclosure are not limited to the embodiments below, and can be performed in various forms that could have been modified and improved by a person skilled in the art within the scope without going out of the summary of the present disclosure.

A spheroidal graphite cast iron of the present disclosure comprises C: 3.5 mass % to 4.2 mass %, Si: 2.0 mass % to 2.8 mass %, Mn: 0.2 mass % to 0.4 mass %, Cu: 0.1 mass % to 0.7 mass %, Mg: 0.02 mass % to 0.06 mass %, Cr: 0.01 mass % to 0.15 mass %, and the balance: Fe and inevitable impurities, wherein Mn+Cr+Cu is 0.431 mass % to 1.090 mass %.

A C (carbon) content is 3.5 mass % to 4.2 mass % relative to the total mass of the spheroidal graphite cast iron. In some embodiments, a C content is 3.5 mass % to 3.9 mass % relative to the total mass of the spheroidal graphite cast iron.

The C content is represented by a value measured by a CS analyzer according to JIS G 1211.

C is an element for forming a graphite structure. Setting the C content in the above range allows a graphite nodule count and a pearlite fraction of the spheroidal graphite cast iron to be in the appropriate range described below, which allows an impact strength at low temperature of the spheroidal graphite cast iron to be improved.

An Si (silicon) content is 2.0 mass % to 2.8 mass % relative to the total mass of the spheroidal graphite cast iron. In some embodiments, an Si content is 2.3 mass % to 2.6 mass % relative to the total mass of the spheroidal graphite cast iron.

The Si content is represented by a value measured by an ICP atomic emission spectrometry according to JIS 1258: 2014 standard.

Si is an element for accelerating crystallization of graphite. Setting the content of Si in the above range moderately accelerates the crystallization of graphite, which allows an impact strength at low temperature of the spheroidal graphite cast iron to be improved.

An Mn (manganese) content is 0.2 mass % to 0.4 mass % relative to the total mass of the spheroidal graphite cast iron. In some embodiments, an Mn content is 0.20 mass % to 0.35 mass % relative to the total mass of the spheroidal graphite cast iron.

The Mn content is represented by a value measured by an ICP atomic emission spectrometry according to JIS 1258: 2014 standard.

Mn is an element for stabilizing a pearlite structure. Setting the content of Mn in the above range allows a pearlite fraction to be in the appropriate range described below, which allows an impact strength at low temperature of the spheroidal graphite cast iron to be improved.

A Cu (copper) content is 0.1 mass % to 0.7 mass % relative to the total mass of the spheroidal graphite cast iron. In some embodiments, a Cu content is 0.15 mass % to 0.66 mass % relative to the total mass of the spheroidal graphite cast iron.

The Cu content is represented by a value measured by an ICP atomic emission spectrometry according to JIS 1258: 2014 standard.

Cu is an element for stabilizing a pearlite structure. Setting the Cu content in the above range allows a pearlite fraction to be in the appropriate range described below, which allows an impact strength at low temperature of the spheroidal graphite cast iron to be improved.

An Mg (magnesium) content is 0.02 mass % to 0.06 mass % relative to the total mass of the spheroidal graphite cast iron. In some embodiments, an Mg content is 0.03 mass % to 0.06 mass % relative to the total mass of the spheroidal graphite cast iron.

The Mg content is represented by a value measured by an ICP atomic emission spectrometry according to JIS 1258: 2014 standard.

Mg is an element having an effect on graphite spheroidization. Setting the Mg content in the above range allows a graphite spheroidization ratio to be maintained constant and prevents generation of a carbide that may reduce an impact strength at low temperature, which allows the impact strength at low temperature of the spheroidal graphite cast iron to be improved.

A Cr (chromium) content is 0.01 mass % to 0.15 mass % relative to the total mass of the spheroidal graphite cast iron. In some embodiments, a Cr content is 0.02 mass % to 0.10 mass % relative to the total mass of the spheroidal graphite cast iron.

The Cr content is represented by a value measured by an ICP atomic emission spectrometry according to JIS 1258: 2014 standard.

Cr is an element for stabilizing a pearlite structure. Setting the Cr content in the above range allows a pearlite fraction to be in the appropriate range described below and prevents generation of a carbide that may reduce an impact strength at low temperature, which allows the impact strength at low temperature of the spheroidal graphite cast iron to be improved.

The balance includes Fe (iron) and inevitable impurities.

Examples of the inevitable impurities include P (phosphorus) and S (sulfur). A P content is not limited. In some embodiments, a P content is 0.1 mass % or less relative to the total mass of the spheroidal graphite cast iron. In some embodiments, a P content is 0.01 mass % to 0.05 mass % relative to the total mass of the spheroidal graphite cast iron. The P content is represented by a value measured by an ICP atomic emission spectrometry according to JIS 1258:2014 standard. An S content is not limited. In some embodiments, an S content is 0.02 mass % or less relative to the total mass of the spheroidal graphite cast iron. In some embodiments, an S content is 0.005 mass % to 0.015 mass % relative to the total mass of the spheroidal graphite cast iron. The S content is represented by a value measured by a CS analyzer according to JIS G 1215.

Setting the P and S contents in the above range prevents generation of a by-product such as steadite that may reduce an impact strength at low temperature, which allows the impact strength at low temperature of the spheroidal graphite cast iron to be improved.

A combination of the Mn, Cr, and Cu (Mn+Cr+Cu) contents is 0.431 mass % to 1.090 mass %.

Setting the Mn+Cr+Cu contents in the above range allows a pearlite fraction of the spheroidal graphite cast iron to be in the appropriate range described below, which allows an impact strength at low temperature of the spheroidal graphite cast iron to be improved.

In the spheroidal graphite cast iron of the present disclosure, a carbon equivalent (CE value=Content of C (mass %)+⅓×Content of Si (mass %)), which is a value that may be considered in this technical field, is not limited. In some embodiments, a carbon equivalent is 4.1 to 4.9. In some embodiments, a carbon equivalent is 4.3 to 4.7.

Setting the CE value in the above range allows fluidity of a molten cast iron to be maintained, reduces shrinkage defects in the spheroidal graphite cast iron, moderately accelerates crystallization of graphite, and increases a graphite spheroidization ratio, which allows an impact strength at low temperature of the spheroidal graphite cast iron to be improved.

A graphite nodule count of the spheroidal graphite cast iron of the present disclosure is 230/mm$^2$ or less. In some embodiments, a graphite nodule count of the spheroidal graphite cast iron of the present disclosure is 200/mm$^2$ or less. A lower limit of a graphite nodule count of the spheroidal graphite cast iron of the present disclosure is not limited. In some embodiments, a graphite nodule count of the spheroidal graphite cast iron of the present disclosure is 150/mm$^2$ or more. In some embodiments, a graphite nodule count of the spheroidal graphite cast iron of the present disclosure is 160/mm$^2$ or more. In some embodiments, a graphite nodule count of the spheroidal graphite cast iron of the present disclosure is 180/mm$^2$ or more. In some embodiments, a graphite nodule count of the spheroidal graphite cast iron of the present disclosure is 150/mm$^2$ to 230/mm$^2$. In some embodiments, a graphite nodule count of the spheroidal graphite cast iron of the present disclosure is 160/mm$^2$ to 200/mm$^2$.

The graphite nodule count of the spheroidal graphite cast iron is calculated in the following manner: An observation site is taken as an image by an optical microscope of 100 to 200 magnifications, and then the image is binarized by an image analysis system to measure number of parts darker than a matrix of 1 mm×0.6 mm (corresponding to graphite). The measurement is performed on three or more sites, and the graphite nodule count of the spheroidal graphite cast iron is determined from an average value of values measured in those sites.

Setting the graphite nodule count of the spheroidal graphite cast iron in the above range allows an impact strength at low temperature of the spheroidal graphite cast iron to be improved.

An upper limit of an average particle size of graphite of the spheroidal graphite cast iron of the present disclosure is not limited. In some embodiments, an average particle size of graphite of the spheroidal graphite cast iron of the present disclosure is 30 μm or less. In some embodiments, an average particle size of graphite of the spheroidal graphite cast iron of the present disclosure is 27 μm or less. A lower limit of an average particle size of graphite of the spheroidal graphite cast iron of the present disclosure is not limited. In some embodiments, an average particle size of graphite of the spheroidal graphite cast iron of the present disclosure is 21 μm or more. In some embodiments, an average particle size of graphite of the spheroidal graphite cast iron of the present disclosure is 22 μm or more. A range of an average particle size of graphite of the spheroidal graphite cast iron of the present disclosure is not limited. In some embodiments, an average particle size of graphite of the spheroidal graphite cast iron of the present disclosure is 21 μm to 30 μm. In some embodiments, an average particle size of graphite of the spheroidal graphite cast iron of the present disclosure is 22 μm to 27 μm.

The average particle size of graphite of the spheroidal graphite cast iron is calculated in the following manner: An observation site is taken as an image by an optical microscope of 50 to 200 magnifications, and the image is then binarized by an image analysis system to measure particle sizes (a circle equivalent diameter) of 300 particles or more, and for example, 450 to 500 particles darker than a matrix (corresponding to the graphite). The average particle size of graphite is determined from an average size of those particles.

In some embodiments, a pearlite fraction of the spheroidal graphite cast iron of the present disclosure is 30% to 85%. In some embodiments, a pearlite fraction of the spheroidal graphite cast iron of the present disclosure is 34% to 83%. In some embodiments, a pearlite fraction of the spheroidal graphite cast iron of the present disclosure is 40% to 60%.

The pearlite fraction of the spheroidal graphite cast iron is calculated by performing an image processing on a metal structure photograph of a cross section of a cast iron including (1) extracting a structure by excluding graphite and (2) extracting a pearlite structure by excluding graphite and ferrite, and then calculating the pearlite fraction of the spheroidal graphite cast iron in accordance with (area of pearlite)/(areas of pearlite+ferrite).

Setting the pearlite fraction of the spheroidal graphite cast iron in the above range allows a balance between a hardness and an elongation of the spheroidal graphite cast iron to be improved, which allows an impact strength at low temperature of the spheroidal graphite cast iron to be improved.

A graphite spheroidization ratio of the spheroidal graphite cast iron of the present disclosure is not limited. In some embodiments, a graphite spheroidization ratio of the spheroidal graphite cast iron of the present disclosure is 75% or more. In some embodiments, a graphite spheroidization ratio of the spheroidal graphite cast iron of the present disclosure is 80% or more. In some embodiments, a graphite spheroidization ratio of the spheroidal graphite cast iron of the present disclosure is 90% or more.

The graphite spheroidization ratio of the spheroidal graphite cast iron is measured according to JIS G 5502:2007 standard.

Setting the graphite spheroidization ratio of the spheroidal graphite cast iron in the above range allows a balance between a hardness and an elongation of the spheroidal graphite cast iron to be improved, which allows an impact strength at low temperature of the spheroidal graphite cast iron to be improved.

A static tensile strength of the spheroidal graphite cast iron at room temperature (15° C. to 30° C.) of the present disclosure is not limited. In some embodiments, a static tensile strength of the spheroidal graphite cast iron at room temperature of the present disclosure is 490 MPa to 750 MPa. In some embodiments, a static tensile strength of the spheroidal graphite cast iron at room temperature of the present disclosure is 550 MPa to 700 MPa.

The tensile strength of the spheroidal graphite cast iron is measured according to JIS Z 2241:2011 standard.

An impact strength at low temperature (−40° C.) (low-temperature impact strength or −40° C. impact strength) of the spheroidal graphite cast iron of the present disclosure is not limited. In some embodiments, an impact strength at low temperature (−40° C.) of the spheroidal graphite cast iron of the present disclosure is 630 MPa to 850 MPa. In some embodiments, an impact strength at low temperature (−40° C.) of the spheroidal graphite cast iron of the present disclosure is 700 MPa to 850 MPa.

The low-temperature impact strength of the spheroidal graphite cast iron is measured by setting a temperature at −40° C. and a strain rate at 5 $sec^{-1}$ under a measurement condition of a tensile strength according to JIS Z 2241:2011 standard.

An impact strength at room temperature (15° C. to 30° C.) (room-temperature impact strength) of the spheroidal graphite cast iron of the present disclosure is not limited. In some embodiments, an impact strength at room temperature (15° C. to 30° C.) of the spheroidal graphite cast iron of the present disclosure is 600 MPa to 800 MPa. In some embodiments, an impact strength at room temperature (15° C. to 30° C.) of the spheroidal graphite cast iron of the present disclosure is 650 MPa to 780 MPa.

The room-temperature impact strength of the spheroidal graphite cast iron is measured by setting a temperature at room temperature and a strain rate at 5 $sec^{-1}$ under a measurement condition of a tensile strength according to JIS Z 2241:2011 standard.

An improvement in the impact strength at low temperature of the spheroidal graphite cast iron of the present disclosure means that the low-temperature impact strength is larger than the tensile strength. In some embodiments, the low-temperature impact strength of the spheroidal graphite cast iron is larger than the tensile strength by 7% or more, and for example, by 10% to 30%. In some embodiments, the low-temperature impact strength of the spheroidal graphite cast iron is larger than the tensile strength by 20% to 25%.

Further, the room-temperature impact strength is also larger than the tensile strength in the present disclosure. In some embodiments, the room-temperature impact strength of the spheroidal graphite cast iron is larger than the tensile strength by 6% or more, and for example, by 7% to 20%. In some embodiments, the room-temperature impact strength of the spheroidal graphite cast iron is larger than the tensile strength by 13% to 20%.

With the spheroidal graphite cast iron having a low-temperature impact strength and a room-temperature impact strength larger than a tensile strength, parts such as undercarriages which receive an impact load can be further optimally designed when the spheroidal graphite cast iron is applied thereto, and such a spheroidal graphite cast iron can contribute to a weight reduction and a cost reduction of the parts.

A Vickers hardness of the spheroidal graphite cast iron of the present disclosure is not limited. In some embodiments, a Vickers hardness of the spheroidal graphite cast iron of the present disclosure is 180 HV20 to 250 HV20. In some embodiments, a Vickers hardness of the spheroidal graphite cast iron of the present disclosure is 190 HV20 to 240 HV20.

The Vickers hardness of the spheroidal graphite cast iron is measured according to JIS Z 2244:2009 standard.

A 0.2% yield strength of the spheroidal graphite cast iron of the present disclosure is not limited. In some embodiments, a 0.2% yield strength of the spheroidal graphite cast iron of the present disclosure is 320 MPa to 440 MPa. In some embodiments, a 0.2% yield strength of the spheroidal graphite cast iron of the present disclosure is 330 MPa to 410 MPa.

The 0.2% yield strength of the spheroidal graphite cast iron is measured by an offset method according to JIS Z 2241:2011 standard.

An elongation after fracture of the spheroidal graphite cast iron of the present disclosure is not limited. In some embodiments, an elongation after fracture of the spheroidal graphite cast iron of the present disclosure is 5% to 21%. In some embodiments, an elongation after fracture of the spheroidal graphite cast iron of the present disclosure is 8% to 20%.

The elongation after fracture of the spheroidal graphite cast iron is measured by a permanent elongation method according to JIS Z 2241:2011 standard.

Setting the Vickers hardness, the 0.2% yield strength, and the elongation after fracture of the spheroidal graphite cast iron of the present disclosure in the above range ensures a physical strength of the spheroidal graphite cast iron.

The spheroidal graphite cast iron of the present disclosure described above can be applied to parts such as a steering knuckle that further requires an impact strength at low temperature.

A method for producing the spheroidal graphite cast iron of the present disclosure includes (i) a preparation step of preparing a molten cast iron adjusted to have a certain composition and (ii) a cooling step of cooling the molten cast iron prepared in (i), in which the cooling step of (ii) includes (a) a first cooling step and (b) a second cooling step.

The steps (i) and (ii) will be described below.

(i) Preparation step of preparing molten cast iron adjusted to have a certain composition In the step (i) of the present disclosure, the molten cast iron is prepared such that the C, Si, Mn, Cu, Mg, and Cr, and Mn+Cr+Cu contents equal to the contents of spheroidal graphite cast iron of the present disclosure described above. In some embodiments, in the step (i) of the present disclosure, the molten cast iron is prepared such that the molten cast iron includes C: 3.5 mass % to 4.2 mass %, Si: 2.0 mass % to 2.8 mass %, Mn: 0.2 mass % to 0.4 mass %, Cu: 0.1 mass % to 0.7 mass %, Mg: 0.02 mass % to 0.06 mass %, and Cr: 0.01 mass % to 0.15 mass %, and Mn+Cr+Cu: 0.431 mass % to 1.090 mass %.

The C content is adjusted by an iron raw material such as a publicly known graphite powder, scrap iron, and pig iron. The Si content is adjusted by an Si metal alone, an iron raw material such as a scrap iron, and a pig iron, an Fe—Si type inoculant, an Fe—Si—Mg type spheroidizing agent, or the like. The Mn content is adjusted by an Mn metal alone, an iron raw material such as a scrap iron, an Fe—Mn type additive, or the like. The Cu content is adjusted by a Cu metal alone or the like. The Mg content is adjusted by an Fe—Si—Mg type spheroidizing agent or the like. The Cr content is adjusted by an iron raw material such as a scrap iron and a pig iron, an Fe—Cr type additive, or the like.

In the step (i) of the present disclosure, an additive such as a spheroidizing agent, a covering material, and an inoculant can be added to the molten cast iron.

The spheroidizing agent is a material for spheroidizing the graphite. Although the spheroidizing agent is not limited, an example thereof includes an Fe—Si—Mg alloy.

The covering material is a material for adjusting the starting time of reaction between the molten cast iron and the spheroidizing agent. Although the covering material is not limited, an example thereof includes an Fe—Si alloy.

In the step (i) of the present disclosure, a preparation temperature of the molten cast iron is not limited. In some embodiments, the molten cast iron is prepared at 1400° C. to 1650° C. In some embodiments, the molten cast iron is prepared at 1500° C. to 1600° C.

In the step (i) of the present disclosure, an adding order, an adding temperature, a mixing method, and a mixing time of each material are not limited, and these are performed according to a method publicly known in this technical field. For example, the molten cast iron is prepared in the following manner in the present disclosure.

Into a high-frequency induction melting furnace, a scrap iron, a pig iron, carbon, and an additional element, and the like as a cast iron raw material are added, and then melted at 1500° C. to 1600° C. to prepare a molten material. After that, the molten material is tapped at approximately 1550° C. and spheroidization of the molten material is carried out in a ladle. After the reaction of magnesium contained in a spheroidizing agent is completed, the resulting molten material is teemed into a mold.

(ii) Cooling step of cooling molten cast iron prepared in (i)

In step (ii) of the present disclosure, the molten cast iron prepared in (i) is cooled by a cooling step including (a) a first cooling step and (b) a second cooling step.

(a) First Cooling Step

In (a) the first cooling step in the cooling step of (ii) of the present disclosure, a cooling rate from a pouring temperature to a temperature at A1 transformation point in an iron-carbon phase diagram is adjusted to 15° C./min to 25° C./min. In some embodiments, a cooling rate from a pouring temperature to a temperature at A1 transformation point in an iron-carbon phase diagram is adjusted to 20° C./min to 25° C./min.

The cooling rate is determined by dividing a temperature difference (° C.) from the pouring temperature to the temperature at A1 transformation point in the iron-carbon phase diagram by a time (minutes) taken to reach the temperature at A1 transformation point in the iron-carbon phase diagram from the pouring temperature, in the figure showing a relationship of a cast iron temperature (vertical axis) to a cooling time (horizontal axis) of the spheroidal graphite cast iron.

A tapping temperature of the molten cast iron from the melting furnace is not limited. In some embodiments, a tapping temperature of the molten cast iron from the melting furnace is 1500° C. to 1600° C. In some embodiments, a tapping temperature of the molten cast iron from the melting furnace is 1540° C. to 1560° C.

A pouring temperature at the time of pouring the molten cast iron into a mold is not limited. In some embodiments, a pouring temperature at the time of pouring the molten cast iron into a mold is 1350° C. to 1450° C. In some embodiments, a pouring temperature at the time of pouring the molten cast iron into a mold is 1380° C. to 1420° C.

The temperature at A1 transformation point in the iron-carbon phase diagram may be changed according to an environmental condition. In some embodiments, the temperature at A1 transformation point in the iron-carbon phase diagram is 720° C. to 760° C. In some embodiments, the temperature at A1 transformation point in the iron-carbon phase diagram is 730° C. to 750° C.

The mold into which the molten cast iron is poured is not limited, and examples thereof include a Y-block mold, a knock-off mold, and the like.

(b) Second Cooling Step

In (b) the second cooling step in the cooling step of (ii) of the present disclosure, a cooling rate from the temperature at A1 transformation point to a temperature at which no further transformation of iron takes place in the spheroidal graphite cast iron is adjusted to 5° C./min to 20° C./min. In some embodiments, a cooling rate from the temperature at A1 transformation point to a temperature at which no further transformation of iron takes place in the spheroidal graphite cast iron is adjusted to 10° C./min to 15° C./min.

The cooling rate is determined by dividing a temperature difference (° C.) from the temperature at A1 transformation point to the temperature at which no further transformation of iron takes place in the spheroidal graphite cast iron by a time taken to reach the temperature at which no further transformation of iron takes place in the spheroidal graphite cast iron from the temperature at A1 transformation point, in the figure showing a relationship of a cast iron temperature (vertical axis) to a cooling time (horizontal axis) of the spheroidal graphite cast iron.

The temperature at which no further transformation of iron takes place in the spheroidal graphite cast iron is not limited. In some embodiments, the temperature at which no further transformation of iron takes place in the spheroidal graphite cast iron is 600° C. to 400° C. In some embodiments, the temperature at which no further transformation of iron takes place in the spheroidal graphite cast iron is 500° C. to 450° C.

In (a) the first cooling step and (b) the second cooling step, setting the cooling rate from the pouring temperature to the temperature at A1 transformation point in the iron-carbon phase diagram and the cooling rate from the temperature at A1 transformation point to the temperature at which no further transformation of iron takes place in the spheroidal graphite cast iron in the above range allows a graphite nodule count and a pearlite fraction of the spheroidal graphite cast iron to be in the appropriate range described above, which allows an impact strength at low temperature of the produced spheroidal graphite cast iron to be improved.

A time between (a) the first cooling step and (b) the second cooling step is not limited. In some embodiments, a time between (a) the first cooling step and (b) the second cooling step is 40 minutes to 70 minutes. In some embodiments, a time between (a) the first cooling step and (b) the second cooling step is 50 minutes to 60 minutes.

EXAMPLES

Hereinafter, some examples relating to the present disclosure will be described. However, the description below is not intended that the present disclosure is limited to the examples below.

1. Production of Samples

Example 1

Into a high-frequency induction melting furnace, a spheroidizing agent and a covering material were introduced and a scrap iron as a raw material was further added, and the materials were heated to 1550° C. to melt. After 20 minutes, an inoculant was added therein and left to stand for 5 minutes to produce a molten cast iron. The produced molten cast iron was teemed into a Y-block mold shown in FIG. 1 and cooled by adjusting the cooling rate of the first cooling step (the cooling rate from the pouring temperature to the temperature at A1 transformation point in the iron-carbon phase diagram) to 20° C./min and the cooling rate of the second cooling step (the cooling rate from the temperature at A1 transformation point to the temperature at which no further transformation of iron takes place in the spheroidal graphite cast iron) to 10° C./min. After the inside of the mold was cooled to a takeout temperature, the cast was taken out of the mold. The details of casting conditions are shown in Table 1.

TABLE 1

| | Casting conditions |
|---|---|
| Melting furnace | High-frequency induction melting furnace |
| Tapping temperature | 1550° C. |
| Pouring temperature | 1400° C. to 1450° C. |
| Takeout condition | 300° C. or less |
| Spheroidization method | Static casting method |
| Spheroidizing agent | TDCR-4 (Fe—Si-4% Mg alloy) manufactured by Toyo Denka Kogyo Co., Ltd. |
| Covering material | TOYO COVER S30 (Fe-28% Si alloy) manufactured by Toyo Denka Kogyo Co., Ltd. |
| Inoculant | CALBALLOY M2 manufactured by Osaka Special Alloy Co., Ltd. |

Examples 2 to 6 and Comparative Examples 1 to 3

Examples 2 to 6 and Comparative Examples 1 to 3 were produced in the same manner as in Example 1 except that amounts of the raw materials to be used were changed.

Figure 2:
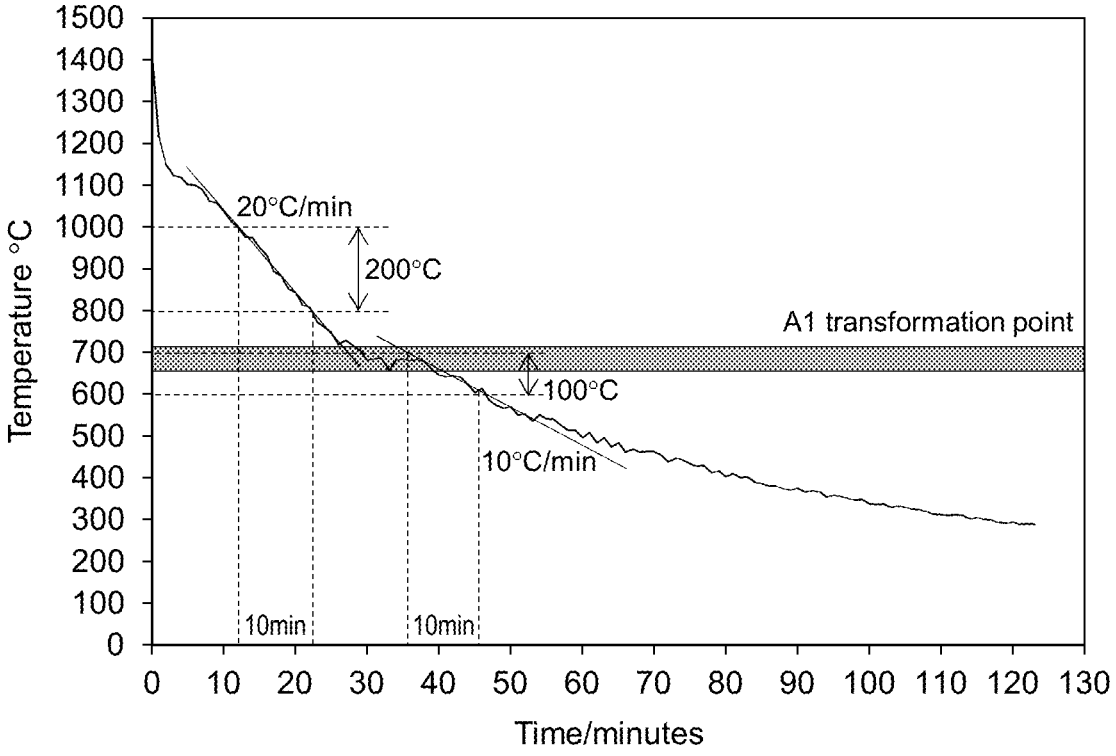
FIG. 2 shows a relationship of a cast iron temperature (vertical axis) to a cooling time (horizontal axis) for a spheroidal graphite cast iron in a production of Example 2.

The cast iron temperature (vertical axis) relative to the cooling time (horizontal axis) of the spheroidal graphite cast iron for producing Example 2 is shown as an example in FIG. 2.

2. Evaluation of Composition of Sample

A chemical composition of the spheroidal graphite cast iron of each of Examples 1 to 6 and Comparative Examples 1 to 3 was measured. C and S were measured by a CS analyzer according to JIS G 1211, and elements other than C and S were measured by an ICP atomic emission spectrometry according to JIS 1258:2014 standard.

The results are shown in Table 2.

TABLE 2

| | Chemical composition, mass % | | | | | | | | CE | Mn + Cr + |
|---|---|---|---|---|---|---|---|---|---|---|
| | C | Si | Mn | P | S | Cr | Cu | Mg | value | Cu |
| Example 1 | 3.58 | 2.48 | 0.25 | 0.019 | 0.010 | 0.021 | 0.16 | 0.050 | 4.4 | 0.431 |
| Example 2 | 3.58 | 2.40 | 0.25 | 0.020 | 0.011 | 0.021 | 0.18 | 0.053 | 4.4 | 0.451 |
| Example 3 | 3.59 | 2.39 | 0.30 | 0.018 | 0.010 | 0.022 | 0.26 | 0.048 | 4.4 | 0.582 |
| Example 4 | 3.58 | 2.42 | 0.23 | 0.020 | 0.009 | 0.035 | 0.33 | 0.055 | 4.4 | 0.595 |
| Example 5 | 3.52 | 2.44 | 0.28 | 0.018 | 0.010 | 0.023 | 0.40 | 0.055 | 4.3 | 0.703 |
| Example 6 | 3.83 | 2.60 | 0.34 | 0.028 | 0.006 | 0.090 | 0.66 | 0.049 | 4.7 | 1.090 |
| Comparative Example 1 | 3.90 | 2.32 | 0.25 | 0.022 | 0.010 | 0.021 | — | 0.053 | 4.7 | — |
| Comparative Example 2 | 3.61 | 2.48 | 0.28 | 0.018 | 0.008 | 0.030 | 0.49 | 0.057 | 4.4 | 0.800 |
| Comparative Example 3 | 3.80 | 2.32 | 0.25 | 0.018 | 0.010 | 0.021 | 0.27 | 0.036 | 4.6 | 0.537 |

A structure photograph, a pearlite fraction, a graphite spheroidization ratio, a graphite nodule count, and an average particle size of graphite of each of Examples 1 to 6 and Comparative Examples 1 to 3 were measured.

Each of the physical properties was measured in the following manner.

The structure photograph was a metal structure photograph of a cross section of the cast iron taken by an optical microscope (manufactured by Olympus Corporation).

The pearlite fraction was calculated by performing an image processing on a metal structure photograph of a cross section of a cast iron, which includes (1) extracting a structure by excluding graphite and (2) extracting a pearlite structure by excluding graphite and ferrite, and then calculating the pearlite fraction in accordance with (area of pearlite)/(areas of pearlite+ferrite).

The graphite spheroidization ratio was measured according to JIS G 5502:2007 standard.

The graphite nodule count was calculated in the following manner: An observation site was taken as an image by an optical microscope of 100 magnifications, and the image was then binarized by an image analysis system to measure number of parts darker than a matrix of 1 mm×0.6 mm (corresponding to the graphite). The measurement was performed on three sites, and the graphite nodule count of the spheroidal graphite cast iron was determined from an average value of values measured in those sites.

The average particle size of graphite was calculated in the following manner: An observation site was taken as an image by an optical microscope of 100 magnifications, and the image was then binarized by an image analysis system to measure particle sizes (diameter equivalent to a circle) of 100 or more particles that are darker than the matrix (corresponding to the graphite). The average particle size of graphite was determined from an average size of those particles.

The results are shown in Table 3.

Figure 3:
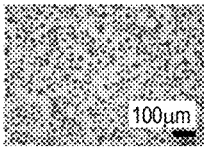
FIG. 3 shows a structure photograph, a pearlite fraction, a graphite spheroidization ratio, a graphite nodule count, and an average particle size of graphite of each of Examples 1 to 6 and Comparative Examples 1 to 3.
Figure 3:
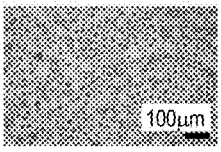
Figure 3:
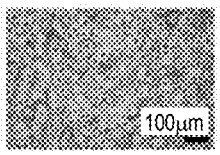
Figure 3:
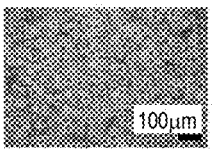
Figure 3:
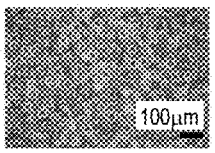
Figure 3:
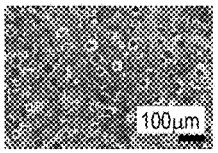
Figure 3:
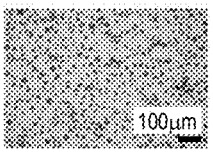
Figure 3:
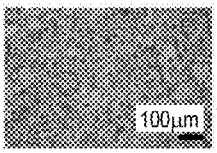

As shown in FIG. 3, in each of Examples 1 to 6, the pearlite fraction was 34% to 83%, the graphite spheroidization ratio was 84% to 95%, the graphite nodule count was 160/mm$^2$ to 200/mm$^2$, and the average particle size of graphite was 22.5 μm to 26.9 μm. On the other hand, Comparative Example 1 had a small pearlite fraction of 14% and Comparative Example 2 had a large pearlite fraction of 89%.

3. Evaluation of Sample 3-1. Preparation of Test Specimens

Figure 4:
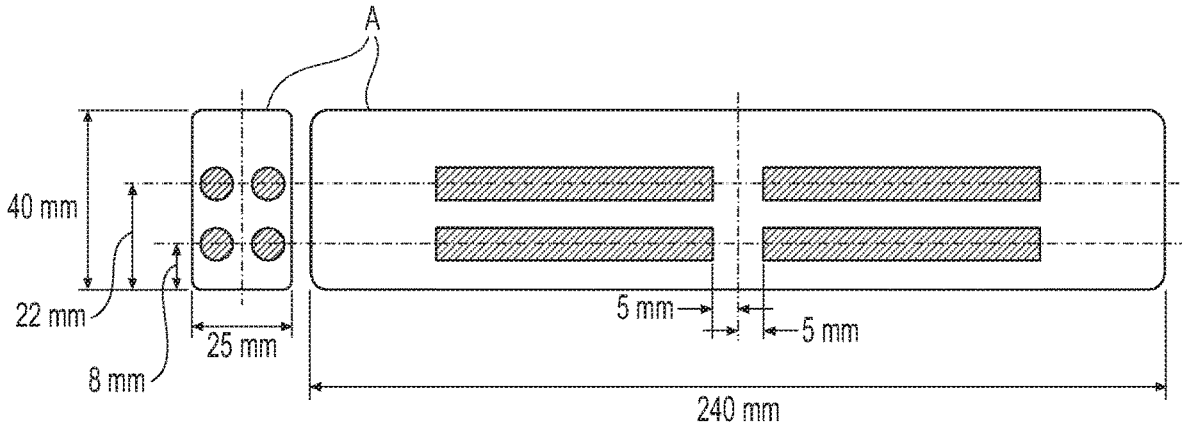
FIG. 4 shows a position to cut out eight test specimens for evaluating samples of Examples and Comparative Examples.

As for Examples 1 to 6 and Comparative Examples 1 to 3, eight test specimens were cut out of the Y-block product produced in "1. Production of samples." A cutting position of the eight test specimens are shown in FIG. 4. The dimensions of FIG. 4 are shown in mm and A denotes a feeder head side.

3-2. Room-Temperature Static Tensile Test of Test Specimens

Two test specimens were taken out of the eight test specimens, and a Vickers hardness, a tensile strength, a 0.2% yield strength, and an elongation after fracture were measured.

Each of the physical properties was measured in the following manner.

The Vickers hardness was measured according to JIS Z 2244:2009 standard.

The tensile strength was measured according to JIS Z 2241:2011 standard.

The 0.2% yield strength was measured by an offset method according to JIS Z 2241:2011 standard.

The elongation after fracture was measured by a permanent elongation method according to JIS Z 2241:2011 standard.

The results are shown in Table 3.

TABLE 3

| | Vickers hardness HV20 | Tensile strength MPa | 0.2% Yield strength MPa | Elongation after fracture % |
|---|---|---|---|---|
| Example 1 | 181 | 499 | 321 | 20.1 |
| Example 2 | 195 | 533 | 335 | 14.7 |
| Example 3 | 210 | 578 | 345 | 16.8 |
| Example 4 | 227 | 644 | 369 | 15.0 |
| Example 5 | 239 | 707 | 406 | 9.6 |
| Example 6 | 244 | 747 | 431 | 7.3 |
| Comparative Example 1 | 149 | 440 | 285 | 22.4 |
| Comparative Example 2 | 252 | 782 | 460 | 6.2 |
| Comparative Example 3 | — | 670 | — | 6.4 |

As shown in Table 3, in each of Examples 1 to 6, the Vickers hardness was 181 HV20 to 244 HV20, the tensile strength was 499 MPa to 747 MPa, the 0.2% yield strength was 321 MPa to 431 MPa, and the elongation after fracture was 7.3% to 20.1%. On the other hand, in Comparative Example 1, the Vickers hardness, the tensile strength, and the 0.2% yield strength were small although the elongation after fracture was large, and in Comparative Example 2, the elongation after fracture was small although the Vickers hardness, the tensile strength, and the 0.2% yield strength were large.

3-3. Low-Temperature Impact Test of Test Specimens

Two test specimens different from the test specimens used in "3-2. Room-temperature static tensile test of test specimens" were used to measure the −40° C. impact strength and the room-temperature impact strength. A strain rate was 5 $sec^{-1}$.

Each of the physical properties was measured in the following manner.

The −40° C. impact strength was measured by setting a temperature at −40° C. and a strain rate at 5 $sec^{-1}$ under the measuring condition of the tensile strength according to JIS Z 2241:2011 standard. The room-temperature impact strength was measured by setting a temperature at 25° C. and the strain rate at 5 $sec^{-1}$ under the measuring condition of the tensile strength according to JIS Z 2241:2011 standard.

Figure 5:
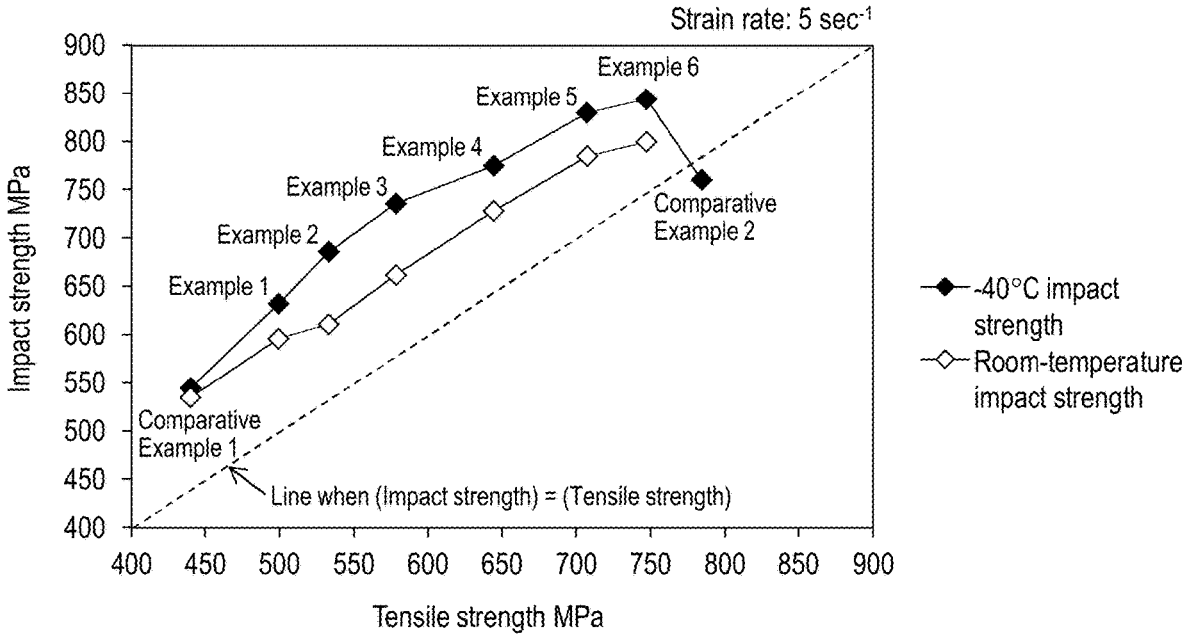
FIG. 5 shows a relationship of a −40° C. impact strength or a room-temperature impact strength to a tensile strength of each Example and Comparative Example.

The results are shown in FIG. 5.

As shown in FIG. 5, in each of Examples 1 to 6, it was found that the −40° C. impact strength of the spheroidal graphite cast iron was larger than the tensile strength by 7% or more. On the other hand, in Comparative Example 1, the −40° C. impact strength of the spheroidal graphite cast iron is smaller as compared to that of Examples 1 to 6 although the −40° C. impact strength of the spheroidal graphite cast iron was larger than the tensile strength, and in Comparative Example 2, the −40° C. impact strength of the spheroidal graphite cast iron was smaller the tensile strength.

The reason that the −40° C. impact strength of the spheroidal graphite cast iron in Comparative Example 2 was smaller than the tensile strength is because Comparative Example 2 had a small elongation after fracture and was therefore fractured before reaching an allowable strain. That is, Comparative Example 2 is considered to be a region where low-temperature embrittlement occurs intensely. Therefore, it is considered that Examples 1 to 6 are regions that should be technologically used in terms of the impact strength.

All publications, patents and patent applications cited in the present description are herein incorporated by reference as they are.

What is claimed is:

1. A spheroidal graphite cast iron comprising:

C: 3.5 mass % to 4.2 mass %;

Si: 2.0 mass % to 2.8 mass %;

Mn: 0.2 mass % to 0.4 mass %;

Cu: 0.1 mass % to 0.4 mass %;

Mg: 0.02 mass % to 0.06 mass %;

Cr: 0.01 mass % to 0.15 mass %; and the balance: Fe and inevitable impurities, wherein Mn+Cr+Cu is 0.431 mass % to 1.090 mass %, a graphite nodule count is 230/$mm^2$ or less, and a pearlite fraction is 30% to 56%.

2. The spheroidal graphite cast iron according to claim 1, comprising Cr in an amount in the range of from 0.01 mass % to 0.035 mass %.

3. The spheroidal graphite cast iron according to claim 1, having a tensile strength in the range of from 490 MPa to 750 MPa.

4. The spheroidal graphite cast iron according to claim 1, having a tensile strength in the range of from 490 MPa to 644 MPa.

5. The spheroidal graphite cast iron according to claim 1, having a 0.2% yield strength in the range of from 320 MPa to 440 MPa.

6. The spheroidal graphite cast iron according to claim 1, having a 0.2% yield strength in the range of from 320 MPa to 369 MPa.

7. A method for producing the spheroidal graphite cast iron according to claim 1, comprising:

(i) a preparation step of preparing a molten cast iron, and (ii) a cooling step comprising:

(a) a first cooling step comprising cooling the molten cast iron prepared in (i) from a pouring temperature to a temperature at A1 transformation point in an iron-carbon phase diagram at a cooling rate of 15° C./min to 25° C./min; and (b) a second cooling step comprising, upon reaching the temperature at A1 transformation point in the first cooling step, cooling from the temperature at A1 transformation point to a temperature at which no further transformation of iron takes place in the spheroidal graphite cast iron at a cooling rate of 10° C./min to 20° C./min.

* * * * *